US008102109B2

(12) United States Patent
Auer et al.

(10) Patent No.: US 8,102,109 B2
(45) Date of Patent: Jan. 24, 2012

(54) LAMP FEATURING AN IMPROVED PINCH GEOMETRY

(75) Inventors: Frank Auer, Herbrechtingen-Bolheim (DE); Gerhard Behr, Altheim (DE); Peter Helbig, Sontheim/Brenz (DE); Christian Seichter, Herbrechtingen (DE); Klaus Wittmann, Sontheim (DE); Sascha Zelt, Beimerstetten (DE)

(73) Assignee: OSRAM AG, Munich (DE)

( * ) Notice: Subject to any disclaimer, the term of this patent is extended or adjusted under 35 U.S.C. 154(b) by 156 days.

(21) Appl. No.: 12/448,283

(22) PCT Filed: Dec. 6, 2007

(86) PCT No.: PCT/EP2007/063405

§ 371 (c)(1),
(2), (4) Date: Jun. 16, 2009

(87) PCT Pub. No.: WO2008/074643

PCT Pub. Date: Jun. 26, 2008

(65) Prior Publication Data

US 2010/0090598 A1 Apr. 15, 2010

(30) Foreign Application Priority Data

Dec. 19, 2006 (DE) ..... 10 2006 060 008

(51) Int. Cl.
*H01J 5/48* (2006.01)
*H01J 5/50* (2006.01)

(52) U.S. Cl. ..... 313/318.01; 313/318.07

(58) Field of Classification Search ..... 313/318.01, 313/318.07, 318.09, 318.1
See application file for complete search history.

(56) References Cited

U.S. PATENT DOCUMENTS

| | | | | |
|---|---|---|---|---|
| 4,119,877 | A | 10/1978 | Grewe et al. | |
| 5,281,889 | A | 1/1994 | Fields et al. | |
| 5,994,825 | A * | 11/1999 | Goto et al. | 313/318.07 |
| 6,075,318 | A * | 6/2000 | Noll et al. | 313/573 |
| 6,215,236 | B1 * | 4/2001 | Gotoh et al. | 313/318.07 |
| 6,781,295 | B2 * | 8/2004 | Dakin et al. | 313/318.07 |
| 7,119,484 | B2 * | 10/2006 | Damm et al. | 313/318.01 |

FOREIGN PATENT DOCUMENTS

| | | |
|---|---|---|
| DE | 196 01 396 | 1/1996 |
| GB | 2 215 026 A | 9/1989 |
| WO | WO 9605610 A1 | 2/1996 |

* cited by examiner

*Primary Examiner* — Toan Ton
*Assistant Examiner* — Kevin Quarterman
(74) *Attorney, Agent, or Firm* — Holtz, Holtz, Goodman & Chick PC

(57) ABSTRACT

Disclosed is a lamp, particularly a halogen incandescent lamp, comprising a bulb that is provided with a pinch seal which is inserted into a base by means of an attachment ring. The attachment ring has a receiving section within which the pinch seal is clampingly fastened by means of attachment ring brackets that are supported on support surfaces. According to the invention, the support surfaces are placed at an angle from the longitudinal axis of the lamp.

6 Claims, 3 Drawing Sheets

LAMP FEATURING AN IMPROVED PINCH GEOMETRY

This application is a U.S. National Phase Application under 35 USC 371 of International Application PCT/EP2007/063405, filed Dec. 6, 2007, which is incorporated herein in its entirety by this reference.

TECHNICAL FIELD

The invention relates to a lamp, in particular a halogen incandescent lamp, with a lamp vessel, which is provided with a pinch seal, which is inserted into a base via a fixing ring, the fixing ring having an accommodating section, in which the pinch seal is fixed in clamping fashion by means of holding tabs of the fixing ring which are supported on supporting faces.

PRIOR ART

Such a lamp is known, for example, from WO 1996/05610 A1 by the Applicant. These conventional vehicle lamps have a transparent lamp vessel which is sealed off at one end by means of a pinch seal. The pinch seal is inserted into a base via a fixing ring, the fixing ring having an accommodating section, in which the pinch seal is fixed in clamping fashion by means of holding tabs supported on supporting projections of the pinch seal. Two supporting projections, which each interact with a holding tab, which is supported on supporting faces of the supporting projections, of the fixing ring, are arranged on each broad side of the pinch seal. In this solution, the supporting faces run at an angle of approximately 90° with respect to the lamp longitudinal axis, with the result that the pinch seal is supported in the direction of the lamp longitudinal axis. In order to support the pinch seal transversely with respect to the lamp longitudinal axis, guide webs are formed on the broad sides of the pinch seal centrally, which guide webs run in the longitudinal direction in each case, engage in corresponding guide cutouts of the fixing ring and fix the pinch seal laterally.

One disadvantage with such lamps is the fact that, in addition to the supporting projections, guide webs are required on the pinch seal in order to laterally support the pinch seal, with the result that such lamps are complex in terms of apparatus and are therefore expensive in manufacture.

DESCRIPTION OF THE INVENTION

The invention is based on the object of providing a lamp in which improved mechanical holding of the pinch seal in the fixing ring is made possible with a minimum amount of complexity in terms of manufacture.

This object is achieved by a lamp, in particular a halogen incandescent lamp, with a lamp vessel, which is provided with a pinch seal, which is inserted into a base via a fixing ring, the fixing ring having an accommodating section, in which the pinch seal is fixed in clamping fashion by means of holding tabs of the fixing ring which are supported on supporting faces, wherein the supporting faces are set at an angle with respect to the lamp longitudinal axis. Particularly advantageous embodiments of the invention are described in the dependent claims.

In the solution according to the invention, the fixing ring support no longer runs perpendicular to the lamp longitudinal axis, as in the prior art according to WO 1996/05610 A1, but passes to the outside with a slight incline, with the result that the pinch seal is also supported laterally in the fixing ring. The pinch-sealing contour according to the invention ensures that the pinch seal is supported both in the direction of the lamp longitudinal axis and perpendicular thereto. As a result, the mechanical stability of the system comprising the lamp vessel, the pinch seal and the base is substantially improved. This is particularly advantageous when inserting the lamp into the headlamp, since relatively high transverse forces act on the fixing system during the automated fitting process which is now conventional. Furthermore, the fact that the pinch seal is supported laterally also reduces the tolerances in this direction, which improves the accuracy of the lamp and therefore also the projected image. The pinch-sealing geometry according to the invention is possible in particular also in the case of lamp vessels made from quartz glass.

In accordance with a particularly preferred exemplary embodiment of the invention, the supporting faces are each arranged at an angle $\alpha$ of less than 90° with respect to the lamp longitudinal axis. Preferably, in each case two supporting projections are formed on a broad side of the pinch seal, which supporting projections each have a supporting face interacting with a holding tab.

It has proven to be particularly advantageous if the supporting faces each have an angle in the range of from approximately 60 to 85° with respect to the lamp longitudinal axis. In a preferred exemplary embodiment, the supporting faces each interact with a corner region of a holding tab.

It has proven to be particularly advantageous in terms of manufacturing if the broad sides of the pinch seal each have at least one depth stop bearing against supporting tabs of the fixing ring. The depth stops make it possible, together with the holding tabs, to fix the pinch seal in the fixing ring axially in terms of its position, without play.

The lateral support of the pinch seal is further improved if the fixing ring has at least two spring tabs, which bear against narrow sides of the pinch seal.

In a preferred exemplary embodiment of the lamp, at least sections of the end sections of the holding tabs and/or spring tabs are arcuate and/or in the form of runners. As a result, the insertion of the pinch seal into the fixing ring is further improved.

The pinch seal is preferably tapered in the direction of the base. This measure further reduces the risk of damage to the pinch seal when it is inserted into the fixing ring and simplifies the shaping of the pinch seal during manufacture thereof.

BRIEF DESCRIPTION OF THE DRAWINGS

The invention will be explained in more detail below with reference to preferred exemplary embodiments. In the drawings.

PREFERRED EMBODIMENTS OF THE INVENTION

The invention will be explained below using a lamp with a base at one end for a vehicle headlamp. The lamp according to the invention is in no way restricted to such lamp types, however.

Figure 1:
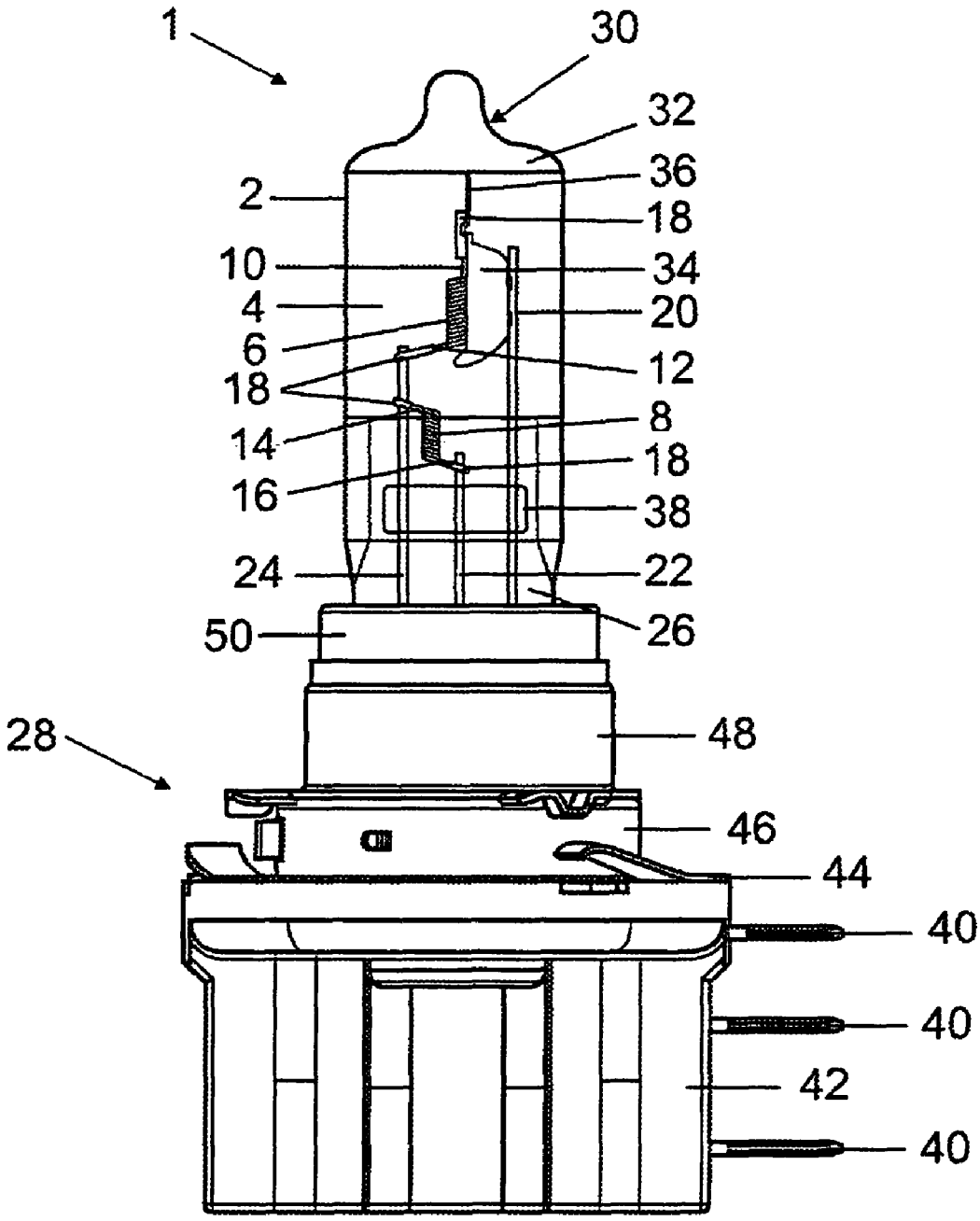
FIG. 1 shows a front view of a lamp according to the invention in the form of a halogen incandescent lamp.

FIG. 1 shows a front view of a lamp 1 according to the invention in the form of a halogen incandescent lamp, as is used, for example, in a vehicle headlamp. This lamp has a substantially cylindrical lamp vessel 2, with two incandescent filaments 6, 8 arranged in the interior 4 of said lamp vessel 2, which incandescent filaments are used, for example, for generating an upper beam and a daytime driving light or an upper beam and a lower beam. The outgoing filament ends 10, 12, 14, 16 of the incandescent filaments 6, 8 are each provided with a welding aid 18 and electrically contact-connected via power supply wires 20, 22, 24. The lamp vessel 2 is sealed off via a pinch seal 26 at one end and inserted into a base 28. The lamp vessel dome 30 remote from the base 28 is provided with an opaque coating 32. Sections of the incandescent filament 6 are surrounded by an anti-dazzle device 34 made from sheet molybdenum, which anti-dazzle device is borne by the power supply wire 20, which is used, together with the power supply wires 22, 24, for supplying power to the two incandescent filaments 6, 8. For this purpose, the outgoing filament end 10 of the incandescent filament 6 is welded to a welding lug 36 of the anti-dazzle device 34 by means of buckle welding and is electrically conductively connected to the power supply wire 20 via said welding lug 36. The second outgoing filament end 12 of the incandescent filament 6 is connected to the power supply wire 24. The outgoing filament end 14 of the incandescent filament 8 is likewise welded to the power supply wire 24. The second outgoing filament end 16 of the incandescent filament 8 is connected to the power supply wire 22. The power supply wires 20, 22, 24 are fixed between two quartz glass webs 38, which are fused with one another, with the result that said power supply wires are arranged in a common plane and are each electrically conductively connected to a contact element 40 in the form of a contact lug. The contact lugs 40 run at an angle of approximately 90° with respect to the direction of the power supply wires 20, 22, 24, protrude laterally out of the base 28 and form the electrical terminals of the halogen incandescent lamp 1. The base 28 has a plastic base part 42 in the form of an injection-molded part, in which base part the contact lugs 40 are embedded. Adjacent to the plastic base part 42 on the lamp vessel side there is a spring ring 44 and a metal sleeve 46, which is embedded in the plastic base part 42 and is connected to a second metal sleeve 48. A fixing ring 50, which is used for holding the pinch seal 26 of the lamp vessel 2, is fastened on the metal sleeve 48. This will be explained in more detail below with reference to FIG. 2, which shows a sectional illustration of the lamp 1 in the region of the fixing ring 50.

Figure 2:
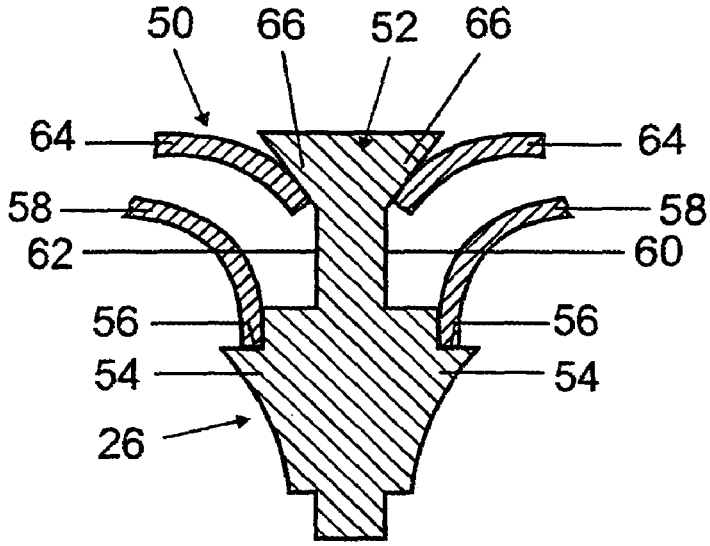
FIG. 2 shows a sectional illustration of the lamp in the region of the fixing ring.

As shown in FIG. 2, the fixing ring 50 has an accommodating section 52, in which the pinch seal 26 is fixed in clamping fashion by means of holding tabs 58 supported on supporting faces 56 formed on supporting projections 54. The supporting projections 54 have a step-shaped design and taper in the direction of the base. It has proven to be particularly advantageous in terms of manufacturing if the broad sides 60, of the pinch seal 26 each have depth stops 66 bearing against supporting tabs 64 of the fixing ring 50.

The depth stops 66 are in the form of projections tapering in the direction of the base and make it possible, together with the holding tabs 58, for the pinch seal 26 to be fixed in the fixing ring 50 axially in terms of its position, without play.

Figure 3:
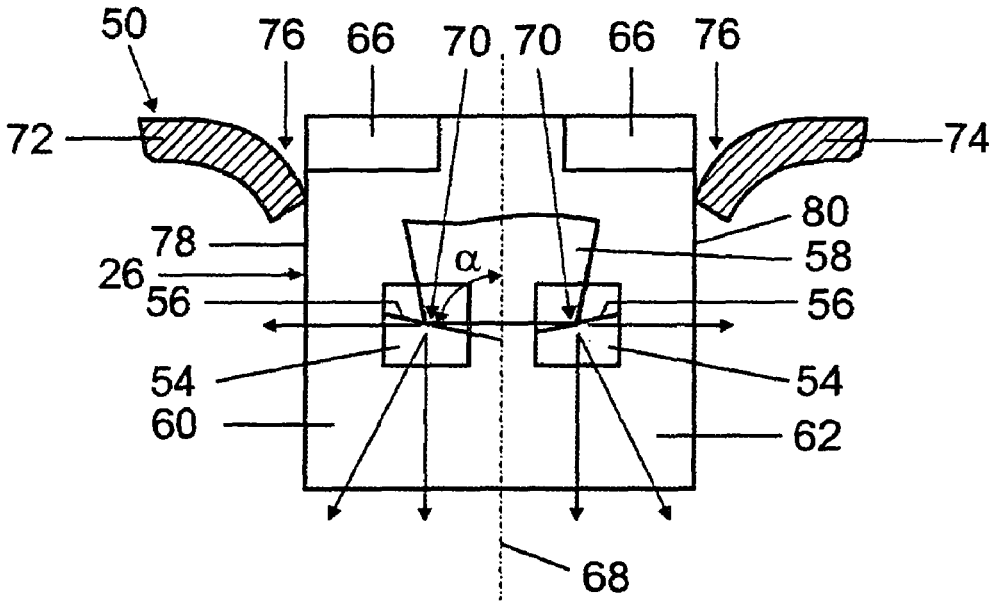
FIG. 3 shows a view of the pinch seal.

As can be seen from FIG. 3, which shows a front view of the pinch seal 26, in each case two supporting projections 54 are arranged on one of the broad sides 60, 62 of the pinch seal 26, which supporting projections each have a supporting face 56 interacting with a holding tab 58. The supporting faces 56 each run at an angle $\alpha$ of less than 90° with respect to a lamp longitudinal axis 68. The fixing ring support passes to the outside with a slight incline. The pinch-sealing contour according to the invention ensures that the pinch seal 26 is supported both in the direction of the lamp longitudinal axis 68 and perpendicular thereto, with the result that the pinch seal 26 is also supported laterally in the fixing ring 50. It has proven to be particularly advantageous if the supporting faces 56 each have an angle $\alpha$ in the range of from approximately 60 to 85° with respect to the lamp longitudinal axis 68. In the exemplary embodiment illustrated, the supporting faces 56 each interact with corner regions 70 of a holding tab 58. The bearing force which is effective can be split, as indicated by arrows, into a component towards the bottom and towards the right or left. As a result, the mechanical stability of the system comprising the lamp vessel, the pinch seal and the fixing ring is substantially improved. This is particularly advantageous when inserting the lamp 1 into the headlamp since relatively high transverse forces act on the fixing system during the automated fitting process which is conventional nowadays. Furthermore, owing to the fact that the pinch seal 26 is supported laterally, the tolerances in this direction are also reduced, which improves the accuracy of the lamp 1 and therefore also the projected image.

The lateral support of the pinch seal 26 is further improved by in each case one spring tab 72, 74 of the fixing ring 50, which are brought to bear against narrow sides 78, 80 of the pinch seal 26 via an end section 76, which is approximately arcuate. In each case two depth stops 66, which, together with the holding tabs 58, make it possible for the pinch seal 26 to be fixed in the fixing ring 50 axially without play, are provided on the broad sides 60, 62 of the pinch seal 26.

Figure 4:
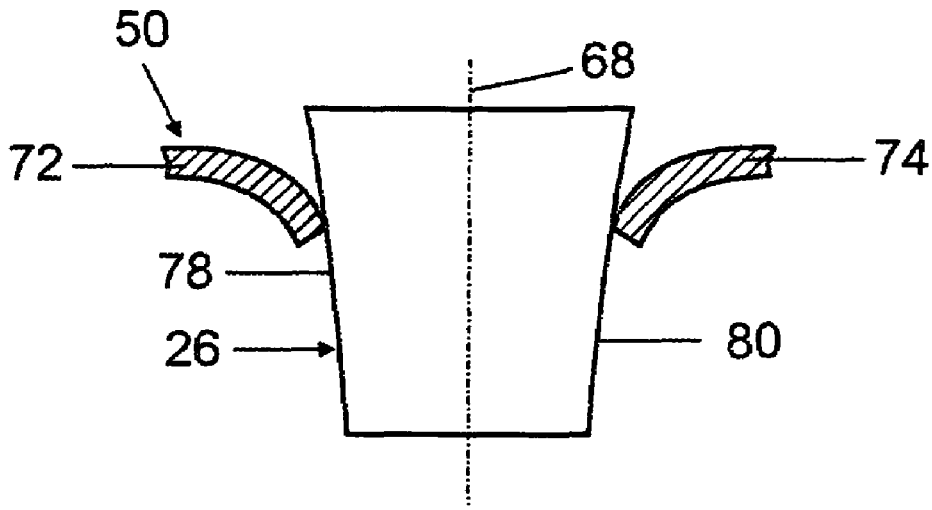
FIG. 4 shows a view of the pinch seal in accordance with a second exemplary embodiment.

FIG. 4 shows an exemplary embodiment of the invention in which the narrow sides 78, 80 of the pinch seal 26 are set at an angle with respect to the lamp longitudinal axis 68, with the result that the pinch seal 26 is tapered in the direction of the base. This measure further reduces the risk of damage to the pinch seal 26 when it is inserted into the fixing ring 50. Furthermore, the tapering pinch seal 26 simplifies the shaping during manufacture of the pinch seal. The supporting projections 54 and depth stops 66 are not illustrated.

Figure 5:
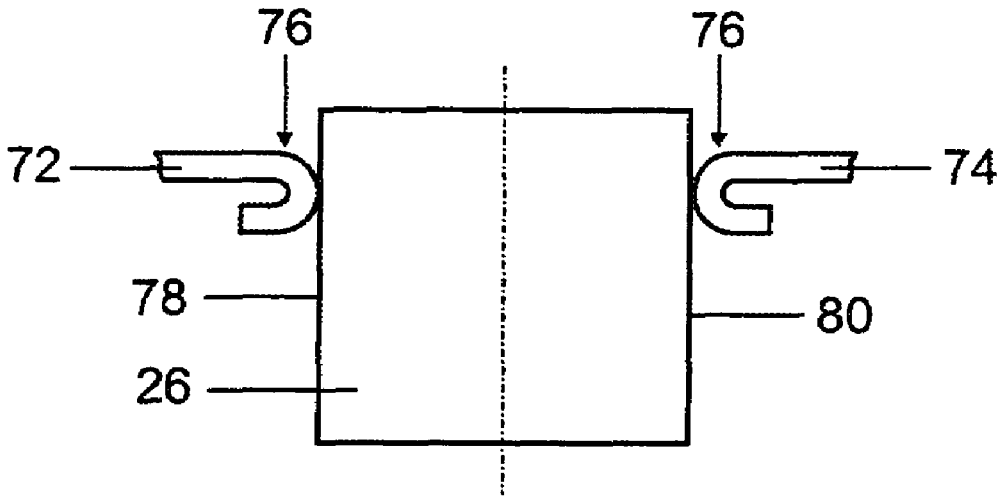
FIG. 5 shows a view of the pinch seal in accordance with a further exemplary embodiment.

FIG. 5 shows an exemplary embodiment of the invention in which sections of the end sections 76 of the spring tabs 72, 74 provided for the lateral support are in the form of runners. As a result, the insertion and the holding of the pinch seal 26 into or in the fixing ring 50 can be further improved.

The invention discloses a lamp 1, in particular a halogen incandescent lamp, with a lamp vessel 2, which is provided with a pinch seal 26, which is inserted into a base 28 via a fixing ring 50, the fixing ring 50 having an accommodating section 52, in which the pinch seal 26 is fixed in clamping fashion by means of holding tabs 58 of the fixing ring 50 which are supported on supporting faces 56. According to the invention, the supporting faces 56 are set at an angle with respect to the lamp longitudinal axis.

The invention claimed is:

1. A lamp with a lamp vessel (2), which is provided with a pinch seal (26) inserted into a base (28) via a fixing ring (50), the fixing ring (50) having an accommodating section (52), in which the pinch seal (26) is fixed in clamping fashion by means of holding tabs (58) of the fixing ring (50) which are supported on supporting faces (56) of the pinch seal (26), and the supporting faces (56) being set at an angle with respect to the lamp longitudinal axis (68) and the supporting faces (56) being formed by in each case two supporting projections (54), which are arranged mirror-symmetrically with respect to the lamp longitudinal axis (68) on a broad side (60, 62) of the pinch seal (26), wherein the supporting projections (54) are arranged in such a way that the supporting faces (56) each run at an angle of less than 90° with respect to the lamp longitudinal axis (68) so as to rise outwards at an angle and each interact with a corner region (70) of a holding tab (58).

2. The lamp as claimed in claim 1, wherein the supporting faces (56) are arranged at an angle in the range of from approximately 60 to 85° with respect to the lamp longitudinal axis (68).

3. The lamp as claimed in claim 1, wherein the broad. sides (60, 62) of the pinch seal (26) each have at least one depth stop (66) bearing against supporting tabs (64) of the fixing ring (50).

4. The lamp as claimed in claim 1, wherein the fixing ring (50) has at least two spring tabs (72, 74), which bear against narrow sides (78, 80) of the pinch seal (26).

5. The lamp as claimed in claim 4, wherein at least sections of the holding tabs (58) or spring tabs (72, 74) are arcuate or in the form of runners.

6. The lamp as claimed in claim 1, wherein the pinch seal (26) is tapered in the direction of the base.

* * * * *